US006789341B1

(12) United States Patent
Badura

(10) Patent No.: US 6,789,341 B1
(45) Date of Patent: Sep. 14, 2004

(54) FIREARM SAFETY DEVICE

(76) Inventor: Mark L. Badura, 2430 Greenbridge Dr., Medford, OR (US) 97504

( * ) Notice: Subject to any disclaimer, the term of this patent is extended or adjusted under 35 U.S.C. 154(b) by 0 days.

(21) Appl. No.: 10/418,026

(22) Filed: Apr. 16, 2003

Related U.S. Application Data

(60) Provisional application No. 60/378,856, filed on May 7, 2002, now abandoned.

(51) Int. Cl.[7] ..... F41A 17/44

(52) U.S. Cl. ..... 42/70.11; 128/876; 24/16 PB

(58) Field of Search ..... 42/70.01, 70.11; 128/876; 24/16 PB

(56) References Cited

U.S. PATENT DOCUMENTS

| | | | | | |
|---|---|---|---|---|---|
| 3,484,905 | A | | 12/1969 | Eberhardt | |
| 3,720,614 | A | | 3/1973 | Goodrich | |
| 4,079,485 | A | * | 3/1978 | Collier et al. | 24/16 PB |
| 4,412,397 | A | * | 11/1983 | Bayn | 42/70.11 |
| 4,516,293 | A | * | 5/1985 | Beran | 24/16 PB |
| 4,665,588 | A | * | 5/1987 | Nakano | 24/16 PB |
| 4,705,245 | A | * | 11/1987 | Osada | 248/74.3 |
| 5,016,377 | A | | 5/1991 | Gunning | |
| 5,038,508 | A | | 8/1991 | Brown | |
| 5,136,758 | A | * | 8/1992 | Wilcox et al. | 24/431 |
| 5,766,218 | A | * | 6/1998 | Arnott | 606/151 |
| 5,934,000 | A | | 8/1999 | Hayes, Sr. | |
| 6,347,435 | B1 | * | 2/2002 | Davignon et al. | 24/16 PB |
| 6,539,589 | B2 | * | 4/2003 | Thompson | 24/16 PB |
| 2002/0189148 | A1 | * | 12/2002 | Hanson | 42/70.11 |
| 2003/0172572 | A1 | * | 9/2003 | Clark | 42/70.11 |

FOREIGN PATENT DOCUMENTS

| | | | | |
|---|---|---|---|---|
| GB | 1014768 | * | 12/1965 | 24/16 PB |

* cited by examiner

*Primary Examiner*—Stephen M. Johnson
(74) *Attorney, Agent, or Firm*—Robert E. Howard

(57) ABSTRACT

A firearm safety device including a stop tab, a locking strap and a lock tab. The stop tab has an inner end adapted to abut against the muzzle of a firearm. The locking strap is attached to the stop tab and is adapted to be insertable into and through the barrel of a firearm. The locking strap has a plurality of transverse teeth located on an outer surface thereof. The lock tab is removably attached to the stop tab and has a lock housing with a transverse aperture extending therethrough that is adapted to receive the locking strap. The lock housing is adapted to allow the teeth of the locking strap to pass through the transverse aperture as the lock tab is being inserted onto the locking strap, but to prevent removal of the lock tab from the locking strap once insertion has started.

4 Claims, 3 Drawing Sheets

FIREARM SAFETY DEVICE

CROSS-REFERENCE TO RELATED APPLICATIONS

This application claims the benefit of U.S. Provisional Application No. 60/378,856, filed May 7, 2002 now abandoned.

BACKGROUND OF THE INVENTION

The present invention relates to a firearm safety device that provides visual proof that there is no ammunition in the barrel of the firearm and prevents ammunition from being loaded therein until the device is removed.

There have been many suggestions for safety devices that prevent firearms from being accidentally discharged. Such prior art devices include trigger locks, magazine locks, firing pin locks, barrel inserts, cable locks, padlocks, chamber plugs, and electronically programmable devices which allow the firearm to be operated only by an authorized user. Such devices are typically expensive because they have been designed to thwart ingenious children from removing the safety device in a household setting.

There is a need, however, for an inexpensive device which can be used in an adult setting where numerous firearms are present, such as police and military firearm storage areas, gun shows, stores where firearms are sold, etc.

SUMMARY OF THE PRESENT INVENTION

It is an object of the present invention to provide a relatively inexpensive safety device for firearms which prevents the firearm from being accidentally discharged.

It is another object of the present invention to provide a firearm safety device that provides excellent visual proof that the firearm is protected from accidental discharge by a safety device.

The firearm safety device of the present invention includes a stop tab, a locking strap and a lock tab.

The stop tab has an inner end adapted to abut against the muzzle of a firearm.

The locking strap extends from the inner end of the stop tab and is integral and unitary therewith. The locking strap is adapted to be insertable into and through the bore of a firearm barrel and out of the breach opening. The locking strap has a plurality of transverse teeth located on an outer surface thereof.

The lock tab is removably attached to the outer end of the stop tab and has a lock housing with an aperture extending therethrough adapted to receive the locking strap and adapted to allow the teeth of the locking strap to pass through as the lock tab is being inserted onto the locking strap but to prevent removal of the lock tab from the locking strap once insertion is complete.

DESCRIPTION OF PREFERRED EMBODIMENTS

The firearm safety device 10 of the present invention includes a stop tab 12, an elongated locking strap 14 extending from the inner end of stop tab 12, locking strap 14 being integral and unitary with stop tab 12, and a lock tab 20 releasably attached to the outer end of stop tab 12.

Stop tab 12 is shown as having a periphery that is generally rectangular in shape, although other shapes could be used, such as circular, oval, etc. The width dimension of stop tab 12 is that dimension perpendicular to the longitudinal axis of locking strap 14 extended, and is of a size that is larger than the largest caliber bore for which the device is intended to be used. The inner end of stop tab 12 is that end attached to locking strap 14, and the outer end of stop tab 12 is that end attached to lock tab 20.

Figure 4:
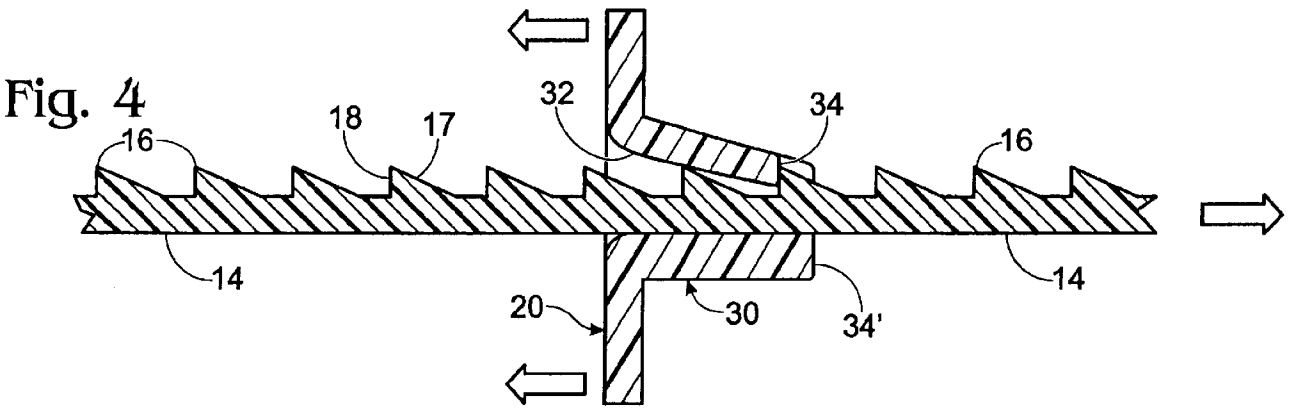
FIG. 4 is an enlarged cross-sectional side view of the lock tab showing a portion of the locking strap locked therein.

Locking strap 14 contains a plurality of locking teeth 16 extending upwardly from the upper surface of locking strap 14 and transverse to the longitudinal axis of locking strap 14. As best seen in FIG. 4, each tooth 16 has a cross-section that is a right triangle with an inclined leading face or ramp 17 and a trailing face 18 that is substantially perpendicular to the longitudinal axis of locking strap 14.

Locking strap 14 has a cross-section that is shown as being generally rectangular in shape, although other cross-sectional shapes, such as circular, may be used.

Figures 1A, 1B, 1C:
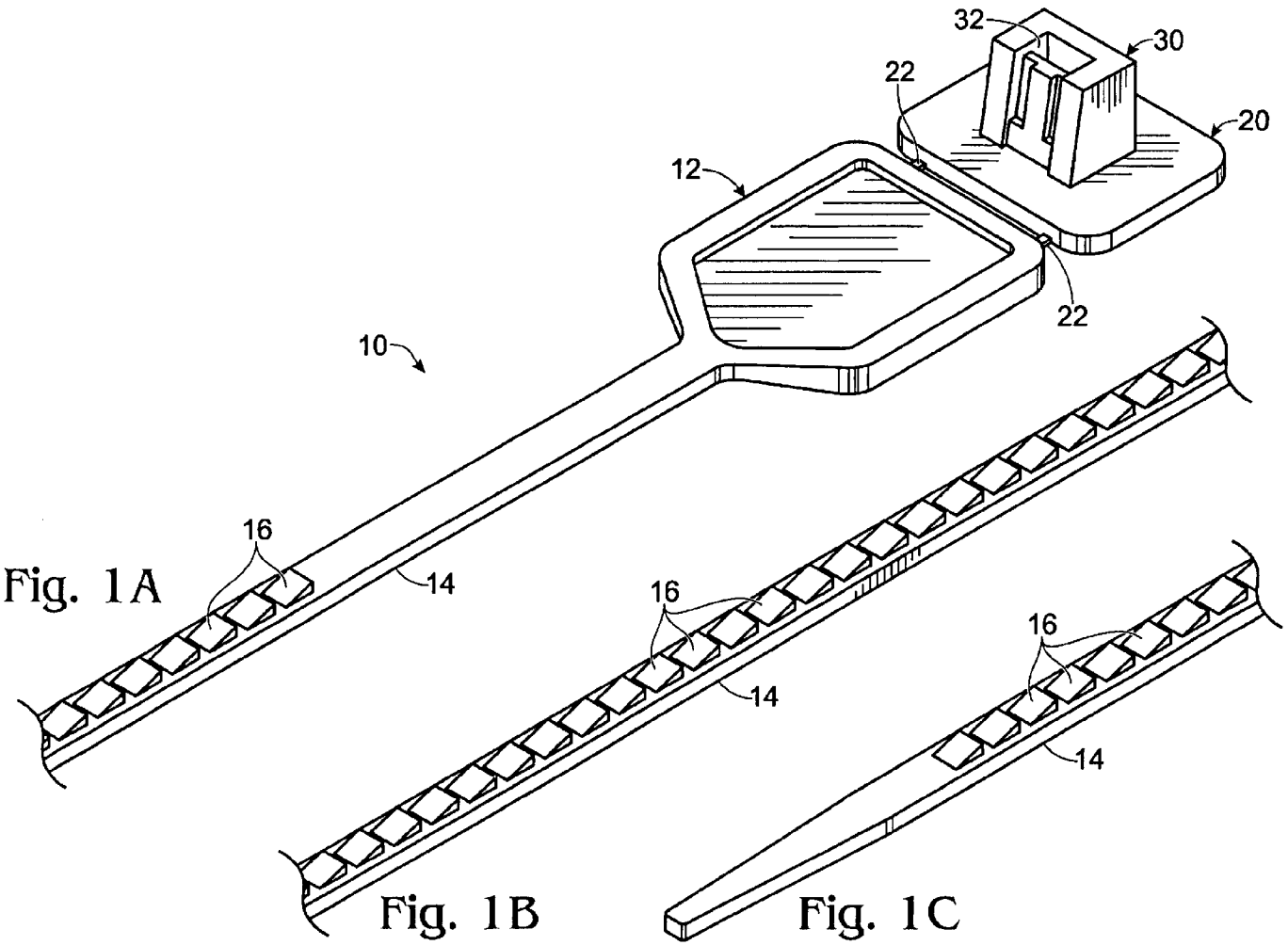
FIGS. 1A, 1B and 1C are top perspective views of the firearm safety device of the present invention.
Figure 2:
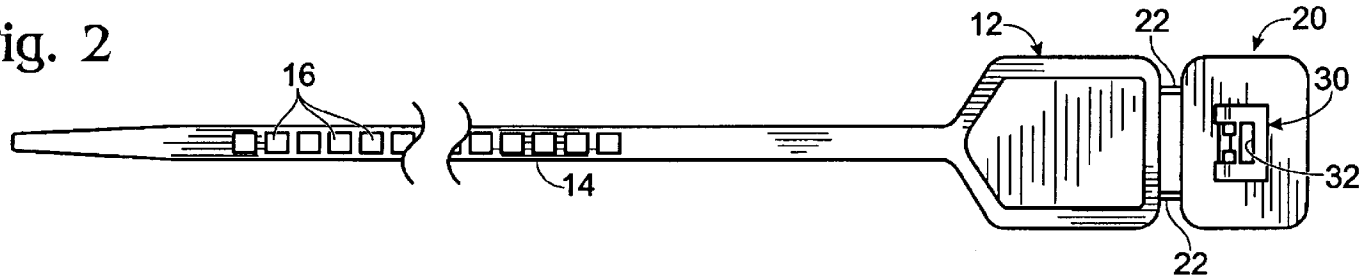
FIG. 2 is a top plan view of the firearm safety device of the present invention.
Figure 3:
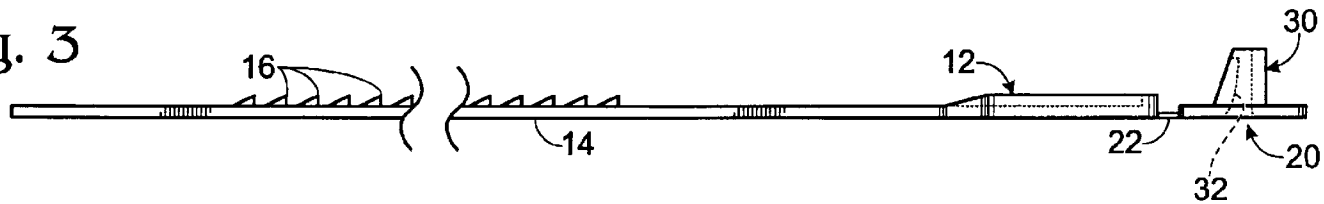
FIG. 3 is a side elevation view of the firearm safety device of the present invention.

Lock tab 20 is releasably attached to stop tab 12 by any suitable means, such as by at least one, but preferably at least two, break-away joints or spiders 22. Preferably lock tab 20 is releasably attached to the outer end of stop tab 12, as seen in FIGS. 1–3. However, lock tab 20 may, alternatively, be releasably attached to one of the side edges of stop tab 12.

A lock housing 30 extends above the upper planar surface of lock tab 20. Lock housing 30 has a transverse aperture 32 extending from an entry end to an exit end thereof. Transverse aperture 32 extends through lock housing 30 and through the adjacent underlying area of lock tab 20, as shown. Lock housing 30 has a sloping rear wall terminating in upper lip 34 and a vertical front wall terminating in upper lip 34'. Substantially parallel side walls extend between the outer edges of the front and rear walls. The front wall and side walls are substantially perpendicular to the upper surface of lock tab 20.

Opposed upper lips 34, 34', together with adjacent sidewalls of lock housing 30, form the exit end of aperture 32. Sloping rear wall terminating in upper lip 34 of lock housing 30 is somewhat flexible and acts as a deflectable restraining member relative to teeth 16 of locking strap 14, as will be discussed further below.

Holes (not shown) may be placed through either or both of stop tab 12 and lock tab 20, respectively, to receive price tags, evidence tags, etc.

Figure 5:
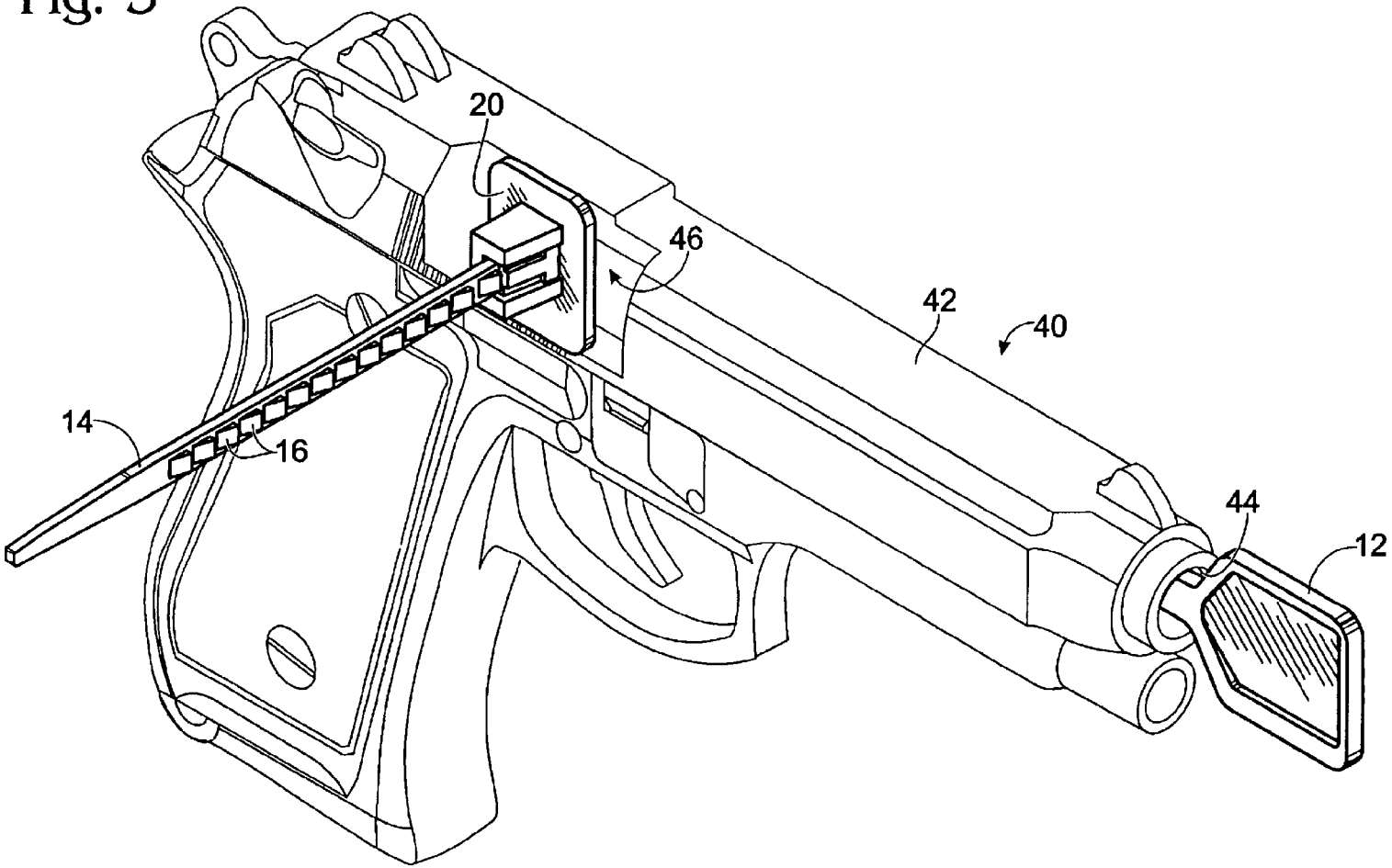
FIG. 5 is a perspective view of a pistol showing the firearm safety device of the present invention locked in place.

In use, the firearm 40 to be secured against accidental discharge is checked, and any cartridge remaining in the barrel 42 removed. Firearm 40 is illustrated in FIG. 5 as an automatic or semi-automatic pistol. However, firearm safety device 10 may be used with other types of pistols or rifles having a breech opening. For use with rifles, locking strap 14 would be longer than for use with pistols.

The tail (free) end of locking strap 14 is inserted into the muzzle 44 of the firearm 40, and pushed therethrough until it enters the breech opening 46 of firearm 40 where it can be pulled outwardly until the inner end of stop tab 12 abuts the muzzle 44 of the firearm 40.

Lock tab 20 is then removed from stop tab 12 by bending lock tab 20 back and forth relative to stop tab 12 until break-away joints 22 break.

The tail end of locking strap 14 is then inserted into the entry opening of aperture 32. The tail end of locking strap 14 has no teeth 16 for a distance sufficient to allow the tail end to extend upwardly from the exit opening of aperture 32 a distance sufficient to allow the user to grasp the tail end with his/her fingers. Lock tab 20 is then pushed inwardly along locking strap 14 in the direction shown by the arrow in FIG. 4 until the lower surface of lock tab 20 abuts firearm 40 adjacent the outer perimeter of breech opening 46.

During positioning of lock tab 20 onto locking strap 14 the sloping walls 17 of locking teeth 16 push flexible lip 34 of lock housing 30 outwardly a distance sufficient to allow teeth 16 to pass through the outer opening of transverse aperture 32.

Upon complete insertion of lock tab 20 onto locking strap 14, the trailing edge 18 of the tooth 16 abutting the upper lip 34 of lock housing 30 prevents lock tab 20 from being removed from strap 14, as best seen in FIG. 4. The firearm 40 is now secure against accidental discharge, and that fact is readily observable by an individual upon seeing stop tab 12 extending from the muzzle 44 and the tail end of locking strap 14 extending from breech opening 46.

The color of stop tab 12 can be selected to be particularly noticeable, such as fluorescent orange or red. Stop tab 12 can contain a suitable inscription, such as "CLEAR BARREL", to further indicate that the firearm is secured against accidental discharge.

In order to provide a "universal" safety device 10, the width of locking strap 14 can be selected to be slightly smaller than the diameter of the smallest caliber commonly available firearm, e.g. 0.20 inch for use with 0.22 caliber and larger caliber firearms. In addition, in such "universal" devices the width of stop tab 12 would be larger than the largest caliber bore for which the device is to be used.

Locking strap 14 can be made available in a variety of lengths to accommodate different barrel lengths, from pistol barrel lengths to rifle barrel lengths.

Locking strap 14 is flexible and is preferably formed of a plastic material, such as nylon. Locking strap 14 has a tensile strength sufficient to prevent breaking by application of manual force. Locking strap 14 must be cut in order to remove it from a firearm to which it is attached. A wire or wires (not shown) may be embedded within locking strap 14 in order to make cutting more difficult.

Stop tab 12, locking strap 14, locking tab 20 and break-away joints 22 are preferably formed as a single piece, such as by injection molding.

It will be obvious to those having skill in the art that many changes may be made to the details of the above-described embodiments of this invention without departing from the underlying principles thereof. The scope of the present invention should, therefore, be determined only by the following claims.

What is claimed is:

1. A firearm safety device comprising:

a stop tab having inner and outer ends, said inner end adapted to abut against the muzzle of a firearm;

an elongated locking strap adapted to be insertable into and through the bore of a firearm barrel, said locking strap having first and second ends and upper and lower surfaces, said first end of said locking strap being attached to said inner end of said stop tab, said locking strap having a plurality of transverse teeth extending above at least a portion of the upper surface thereof;

a lock tab having upper and lower planar surfaces, said lock tab being removably attached to said stop tab by at least two break-away joints; and a lock housing extending from at least one of the planar surfaces of said lock tab, said lock housing having a transverse aperture adapted to receive said locking strap for insertion therethrough, said lock housing adapted to receive and allow said transverse teeth of said locking strap to pass through said transverse aperture during insertion but to prevent removal of said locking strap from said lock housing after insertion has commenced.

2. The firearm safety device of claim 1 wherein said lock tab is removably attached to said outer end of said stop tab.

3. A method for securing a firearm against accidental discharge comprising:

opening the breech of the firearm;

removing any cartridges from the barrel of the firearm;

obtaining a firearm safety device having a stop tab, elongated locking strap and lock tab, said stop tab having inner and outer ends, said elongated locking strap having first and second ends and upper and lower surfaces, said first end of said locking strap being attached to said inner end of said stop tab, said locking strap having a plurality of transverse teeth extending above at least a portion of the upper surface thereof, said lock tab having upper and lower planar surfaces, said lock tab being removably attached to said stop tab, said lock tab having a lock housing extending from at least one of the planar surfaces of said lock tab, said lock housing having a transverse aperture adapted to receive said locking strap for insertion therethrough, said lock housing adapted to receive and allow said transverse teeth of said locking strap to pass through said transverse aperture during insertion but to prevent removal of said locking strap from said lock housing after insertion has commenced;

inserting said locking strap into the bore of said firearm until said locking strap exits the breech opening of said firearm and said stop tab abuts against the muzzle of said firearm;

removing said lock tab from said stop tab; and inserting said locking strap into said lock housing of said lock tab until said lock tab abuts against said firearm.

4. A method for securing a firearm against accidental discharge comprising:

opening the breech of the firearm;

removing any cartridges from the barrel of the firearm;

taking a firearm safety device having a stop tab, elongated locking strap and lock tab, said stop tab having inner and outer ends, said elongated locking strap having first and second ends and upper and lower surfaces, said first end of said locking strap being attached to said inner end of said stop tab, said locking strap having a plurality of transverse teeth extending above at least a portion of the upper surface thereof, said lock tab having upper and lower planar surfaces, said lock tab being removably attached to said stop tab, said lock tab having a lock housing extending from at least one of the planar surfaces of said lock tab, said lock housing having a transverse aperture adapted to receive said locking strap for insertion therethrough, said lock housing adapted to receive and allow said transverse teeth of said locking strap to pass through said transverse aperture during insertion but to prevent removal of said locking strap from said lock housing after insertion has commenced;

removing said lock tab from said stop tab;

inserting said locking strap into the bore of said firearm until said locking strap exits the breech opening of said firearm and said stop tab abuts against the muzzle of said firearm; and inserting said locking strap into said lock housing of said lock tab until said lock tab abuts against said firearm.

* * * * *